US005362341A

United States Patent [19]

Palmer et al.

[11] Patent Number: 5,362,341

[45] Date of Patent: Nov. 8, 1994

[54] METHOD OF PRODUCING ALUMINUM CAN SHEET HAVING HIGH STRENGTH AND LOW EARING CHARACTERISTICS

[75] Inventors: Scott L. Palmer, Apollo; Robert E. Sanders, New Kensington, both of Pa.; W. Bryan Steverson, Maryville; Lyndon Morgan, Knoxville, both of Tenn.

[73] Assignee: Aluminum Company of America, Pittsburgh, Pa.

[21] Appl. No.: 4,104

[22] Filed: Jan. 13, 1993

[51] Int. Cl.[5] ..... C22F 1/04

[52] U.S. Cl. ..... 148/692; 148/696; 148/437; 148/438; 148/439

[58] Field of Search ..... 148/692, 696, 437, 438, 148/439

[56] References Cited

U.S. PATENT DOCUMENTS

| | | | |
|---|---|---|---|
| 3,318,738 | 5/1967 | Winter | 148/439 |
| 3,486,947 | 12/1969 | Pryor et al. | 148/692 |
| 3,802,931 | 4/1974 | Bylund | 148/437 |
| 4,260,419 | 4/1981 | Robertson | 420/534 |
| 4,269,632 | 5/1981 | Robertson et al. | 148/439 |
| 4,282,044 | 8/1981 | Robertson et al. | 148/523 |
| 4,284,437 | 8/1981 | Baba et al. | 148/692 |
| 4,412,870 | 11/1983 | Vernam et al. | 148/439 |
| 4,501,627 | 2/1985 | Althoff | 148/437 |
| 4,502,900 | 3/1985 | Althoff | 148/440 |
| 4,605,448 | 8/1986 | Baba et al. | 148/439 |
| 4,637,842 | 1/1987 | Jeffrey et al. | 148/417 |
| 4,645,544 | 2/1987 | Baba et al. | 148/417 |
| 4,707,195 | 11/1987 | Tsuchida et al. | 148/439 |
| 4,753,685 | 6/1988 | Usui et al. | 148/439 |
| 4,929,285 | 5/1990 | Zaidi | 148/437 |
| 5,110,371 | 5/1992 | Moriyama et al. | 148/437 |

FOREIGN PATENT DOCUMENTS

| | | |
|---|---|---|
| 0121620 | 10/1984 | European Pat. Off. . |
| 0282162 | 9/1988 | European Pat. Off. . |
| 54-066313 | 5/1979 | Japan . |
| 57-149459 | 9/1982 | Japan . |
| 57-057551 | 12/1982 | Japan . |
| 58-126967 | 7/1983 | Japan . |
| 61-007465 | 3/1986 | Japan . |
| 61-019705 | 5/1986 | Japan . |
| 61-060143 | 12/1986 | Japan . |
| 61-288055 | 12/1986 | Japan . |
| 61-288056 | 12/1986 | Japan . |
| 62-001467 | 1/1987 | Japan . |
| 62-003231 | 1/1987 | Japan . |
| 62-006740 | 2/1987 | Japan . |
| 62-013421 | 3/1987 | Japan . |
| 62-037705 | 8/1987 | Japan . |
| 62-263954 | 11/1987 | Japan . |
| 63-007354 | 1/1988 | Japan . |
| 63-028850 | 2/1988 | Japan . |
| 63-149349 | 6/1988 | Japan . |
| 63-282245 | 11/1988 | Japan . |
| 63-282246 | 11/1988 | Japan . |
| 64-009388 | 2/1989 | Japan . |
| 64-087740 | 3/1989 | Japan . |
| 1123054 | 5/1989 | Japan . |

OTHER PUBLICATIONS

Hutchinson et al. "Control of Microstructure and Earing Behavior in Aluminum Alloy 3004 Hot Bands"-*Materials Science and Technology*, Nov. 1989 vol. 5, No. 11 (pp. 1113–1127).

*Primary Examiner*—Richard O. Dean
*Assistant Examiner*—Robert R. Koehler
*Attorney, Agent, or Firm*—David V. Radack; David W. Brownlee

[57] ABSTRACT

A method of producing aluminum can sheet having high strength and low earing characteristics comprises providing an aluminum alloy ingot and then hot rolling the ingot in a single-stand hot reversing mill to produce a first intermediate gauge sheet. The first intermediate gauge sheet is then cold rolled to produce a second intermediate gauge sheet. This second intermediate gauge sheet is passed through a heat source as a single web so that the second intermediate gauge sheet is continuously annealed. After heating, the second intermediate gauge sheet is quenched and coiled again. Finally, the coiled second intermediate gauge sheet is cold rolled again to produce the final gauge aluminum can sheet having high strength and low earing characteristics.

26 Claims, 2 Drawing Sheets

METHOD OF PRODUCING ALUMINUM CAN SHEET HAVING HIGH STRENGTH AND LOW EARING CHARACTERISTICS

BACKGROUND OF THE INVENTION

This invention relates to a method of producing aluminum can sheet having high strength and low earing characteristics and more specifically to hot rolling aluminum can sheet ingot in a single-stand reversing hot finish mill and subsequently cold rolling using an intermediate gauge continuous anneal before cold rolling the sheet again to its final thickness.

In the formation of aluminum can sheet into cup-shaped articles, a characteristic known as "earing" manifests itself as a scalloped appearance around the top edge of the formed cup. The scallops, or ears as they are more commonly known, are formed during the deep drawing step in the fabrication of the cup and represent an undesirable feature of the article. In can body stock the cup is subsequently ironed in multiple rings which accentuates the scalloped ears. High earing, therefore, can create transport problems with the cup as well as insufficient trim after ironing, clipped ears, and trimmer jams all of which are unacceptable in can manufacturing. Thus, it is desired to minimize earing in aluminum can sheet in order to avoid these costs and to increase the quality of the cup. See U.S. Pat. No. 3,318,738, the disclosure of which is incorporated herein by reference.

It is also desirable to provide high strength in aluminum can sheet. Strength is measured by evaluating the yield strength after subjecting tensile specimens to an air temperature of 204° C. (400° F.) for 20 minutes. This process simulates the lacquer curing process of the formed and coated can and is therefore used as an indication of the finished can strength. As is well known, the yield strength measurement is obtained from a tension test in which a specimen is subjected to increasing axial load until it fractures. The yield strength is defined as the stress which will produce a small amount of permanent deformation.

Heretofore, in order to obtain acceptable low earing and high strength characteristics, a multiple-stand hot continuous mill was usually employed. As can be seen in FIG. 1, this involves providing one or more hot reversing or breakdown mills 10 which roll the 12 inch–24 inch thick incoming ingot 12 to an intermediate gauge slab 14. The intermediate gauge slab 14 is then introduced into a series of 3–6 (three are shown in FIG. 1) hot rolling stands 16, collectively referred to as a "hot continuous mill", to reduce the intermediate gauge slab 14 to an approximately 0.1 inch thick final hot rolled sheet 17. The final thickness hot rolled sheet 17 is then coiled on a coil 18. The coil 18 can then optionally be batch annealed at 315° C. to 426° C. (600°–800° F.) for 1–6 hours in a furnace 20. After this the sheet 17 is unwound from coil 18 and cold rolled in a cold rolling mill 22 to produce the final thickness sheet 24 (0.0100–0.0130 inches thick) which is subsequently wound onto coil 26.

The hot continuous mill, while effective in producing low earing and high strength characteristics in the aluminum can sheet, represents a major capital expenditure. In addition, this process requires extensive coordination of the individual roll stands within the continuous mill for successful fabrication. Thus, it would be desirable to eliminate the hot continuous mill in order to substantially reduce the capital expense for producing aluminum can sheet, but only if aluminum can sheet can be produced which has low eating and high strength characteristics.

However, until the invention described herein, attempts to produce aluminum can sheet by eliminating the hot continuous mill have not been successful in producing aluminum can sheet having commercially acceptable low earing and high strength characteristics. These known processes in which the hot continuous mill has been eliminated produce aluminum can sheet having either unacceptably high earing or unacceptably low post-bake yield strength or both.

Thus, there is a need for an improved method of producing aluminum can sheet in a single-stand hot reversing mill that has low earing and high strength characteristics.

SUMMARY OF THE INVENTION

The method of the invention has met the above-described need. The method of producing aluminum can sheet having high strength and low earing characteristics comprises providing an aluminum alloy ingot and then hot rolling the ingot in a single-stand hot reversing mill to produce a first intermediate gauge sheet. The first intermediate gauge sheet is then cold rolled to produce a second intermediate gauge sheet. This second intermediate gauge sheet is passed through heating means so that the second intermediate gauge sheet is continuously annealed. After heating, the second intermediate gauge sheet is quenched and coiled again. Finally, the coiled second intermediate gauge sheet is cold rolled again to produce the final gauge aluminum can sheet having high strength and low earing characteristics.

BRIEF DESCRIPTION OF THE DRAWINGS

A full understanding of the invention can be gained from the following description of the preferred embodiment when read in conjunction with the accompanying drawings in which.

DETAILED DESCRIPTION

Figure 1B:
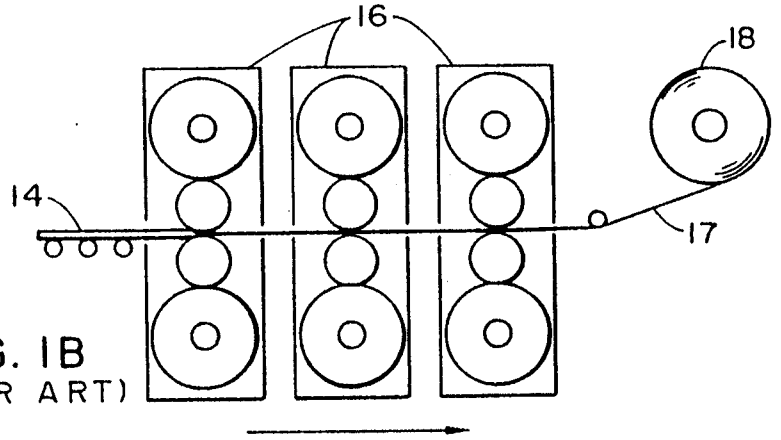
FIG. 1B (PRIOR ART)
FIG. 1 is a schematic drawing of the prior art method of using a hot continuous mill.
Figure 1D:
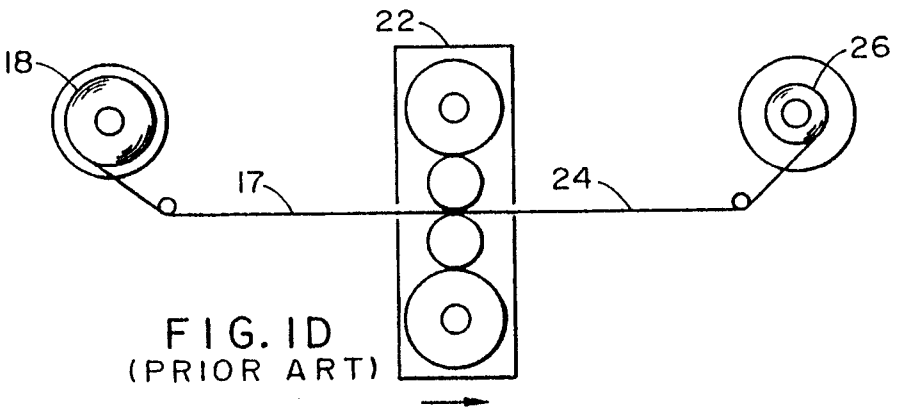
FIG. 1D (PRIOR ART)
Figure 1A:
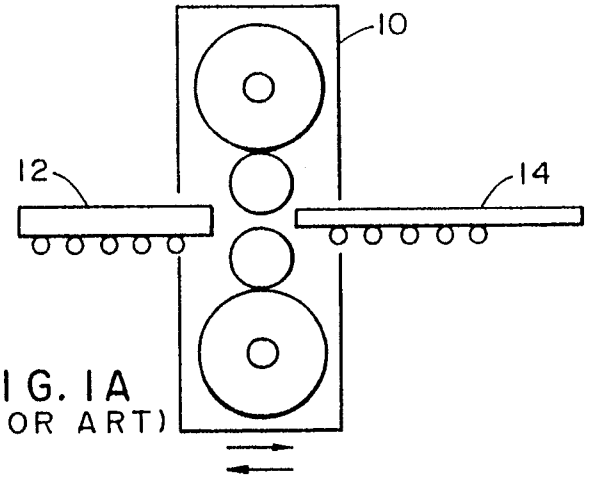
FIG. 1A (PRIOR ART)
Figure 1C:
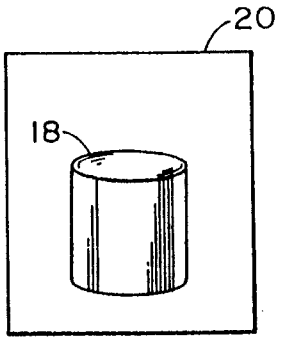
FIG. 1C (PRIOR ART)
Figure 2C:
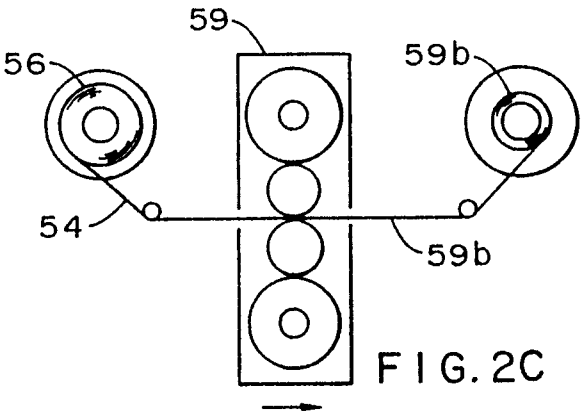
FIG. 2 is a schematic drawing showing an embodiment of the invention wherein a single-stand hot mill is utilized.
Figure 2B:
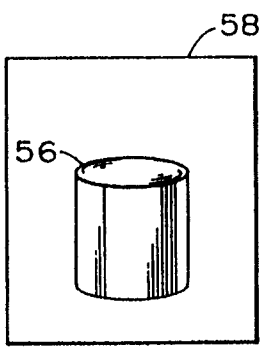
Figure 2A:
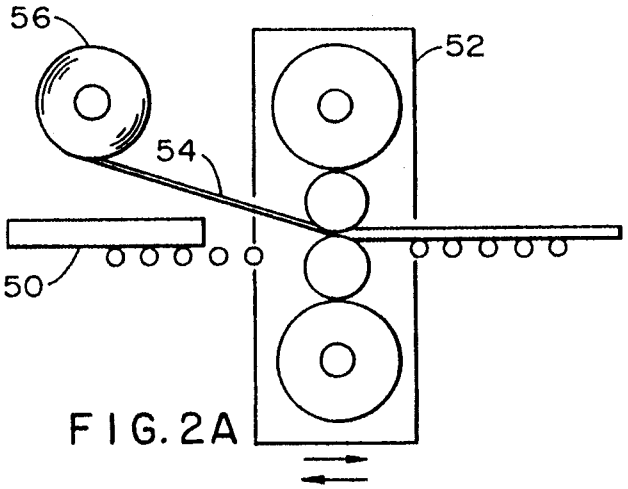
Figure 2E:
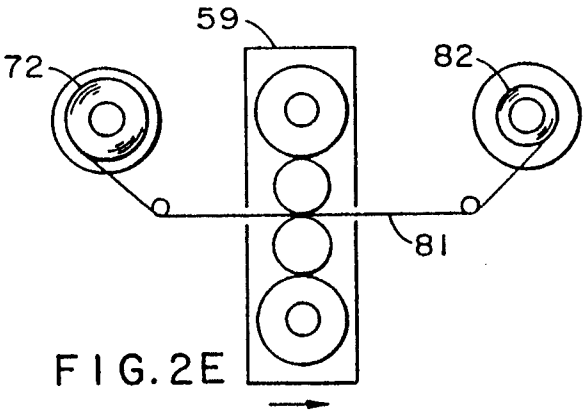
Figure 2D:
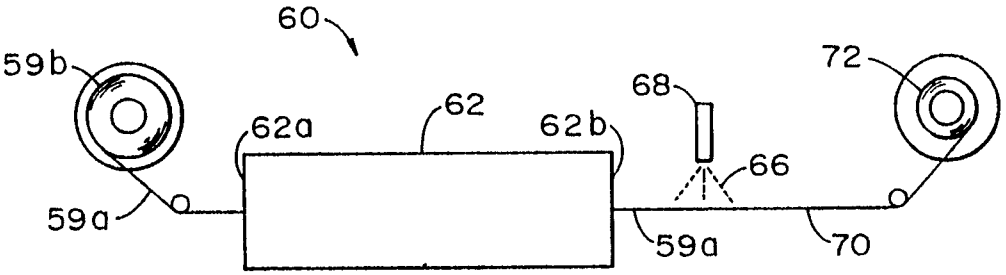

Referring now particularly to FIG. 2, a schematic drawing illustrating an embodiment of the invention is shown. An ingot 50 is shown which is ready to be hot rolled. The ingot 50 is an aluminum alloy which is suitable for use as can sheet such as 3004 or 3104 alloy containing about 0.10 to 0.30% Si, about 0.20 to 0.50% Fe, about 0.10 to 0.25% Cu, about 0.8 to 1.5% Mn and about 0.8 to 1.5% Mg, the balance being aluminum and incidental elements and impurities.

The ingot 50 is pretreated in a known way by machining or scalping the surfaces thereof to remove a portion of the metal thickness from each surface. This will remove surface defects from the ingot 50 which are created during the casting process. Following scalping, the ingot 50 is heated in a furnace and held at this raised temperature for a period of time. The ingot 50 is then cooled, while in the furnace, at a controlled rate for a certain period of time and then is cooled to a hot rolling temperature.

The pretreated ingot 50 is now ready to be hot rolled in the single-stand reversible hot rolling mill 52. The pretreated ingot 50 has a thickness of about 26.5 to 60.0 cm (10.4 to 23.6 inches), with 51 cm (20 inches) being preferred. The ingot 50 is successively hot rolled on the single-stand hot rolling mill 52 to a thickness of about 0.18 to 0.64 cm (0.070 to 0.250 inches), with 0.30 cm (0.120 inches) being preferred to produce a first intermediate gauge sheet 54. The first intermediate gauge sheet 54 exits the single stand hot rolling mill 52 at a temperature of about 249° to 405° C. (480° to 760° F.), with 350° C. (662° F.) being preferred. The first intermediate gauge sheet 54 is wound onto a coil 56. After this, the exit temperature of the first intermediate gauge sheet 54 is determined. If the exit temperature of the first intermediate gauge sheet 54 is lower than about 343° C. (650° F.), the coil 56 is annealed in a box type furnace 58 at about 329° to 399° C. (625° to 750° F.) with 360° C. (680° F.) being preferred and held at that temperature for about 1–12 hours, with about 2 hours being preferred and then allowed to cool to room temperature. If the exit temperature is higher than about 343° C. (650° F.), the coil 56 will "self anneal" due to the latent heat of hot rolling and thus the annealing step set forth above is not necessary.

After annealing, first intermediate gauge sheet 54 is then cold rolled in cold mill 59 to produce a cold rolled second intermediate gauge sheet **59*a* having a thickness of about 0.05 to 0.127 cm (0.020 to 0.050 inches). This colt rolled second intermediate gauge sheet 59*a* is then wound on a coil 59*b*. The coil 59*b* containing the cold rolled second intermediate gauge sheet 59*a* is then moved to a continuous anneal line 60**.

At the continuous anneal line 60, the cold rolled second intermediate gauge sheet **59*a* is uncoiled from coil 59*b* and passes through an elongated heating means 62. The heating means 62 has an entrance end 62*a* into which the sheet 59*a* is introduced and an exit end 62*b* out of which the sheet 59*a* emerges after being continuously annealled. As the sheet 59*a* is passed continuously through the heating means 62 as a single web, the heat-up rate of the sheet 59*a*** is greatly increased over that of batch annealling.

The heating means 62 is maintained at a temperature of about 427° to 566° C. (800° to 1050° F.), with 524° C. (975° F.) being preferred. The heat treatment can take place in as little as 45 seconds, or less, for example 30 to 60 seconds, with times of about 2 to 180 seconds at the heat treating temperature being suitable. The heating means 62 can be an electrical induction furnace or forced air convection furnace. The exit temperature of the sheet **59*a*** is about 524° C. (975° F.).

After exiting the heating means 62 at exit end **62*b*, the cold rolled second intermediate gauge sheet 59*a* is sprayed by a coolant, such as water 66, from water jets 68 supplied by a water source (not shown). It will be appreciated that the coolant can also be air from air jets supplied from a pressurized air source. The coolant acts to rapidly quench the cold rolled second intermediate gauge sheet 59*a*. This will enhance the strain hardening rate (strengthening) of the cold rolled second intermediate gauge sheet 59*a* during the subsequent cold rolling by minimizing the precipitation of solute (Cu, Mg, Mn atoms) in the sheet which would otherwise have occurred during slow cooling. The quenched cold rolled second intermediate sheet 70 is then wound on a coil 72. It is preferred that the quench rate is at least 10° C./sec (18° F./sec) from heat treatment temperature to a temperature of 10° to 121° C. (50° to 250° F.) with 32° C. (90° F.) being preferred for the quenched cold rolled second intermediate sheet 70** after quenching.

The coil 72 of quenched cold rolled second intermediate sheet 70 is then cold rolled through cold mill 59 to the final thickness of about 0.0254 to 0.033 cm (0.010 to 0.013 inches), and the final gauge sheet 81 is wound onto a coil 82.

EXAMPLE

As an example of the application of the present invention, an aluminum melt was adjusted to have the concentration of elements listed in Table 1.

TABLE 1

| Si | Fe | Cu | Mn | Mo |
|---|---|---|---|---|
| 0.17 | 0.39 | 0.19 | 1.11 | 1.5 |

The resulting alloy composition was cast by the direct chill method into 4 ingots of dimensions 50 cm×147 cm×518 cm (19.7 in.×58 in.×204 in.)

The broad surfaces of all four ingots were scalped to remove about 1.5 cm (0.6 inch) casting roughness from each surface. Following machining the ingots were heated in a furnace to a temperature of about 593° C. (1100° F.), holding at this temperature for 4 hours, then cooling the ingots at a controlled rate of 6° C./hour (11° F./hour) to a temperature of about 510° C. (950° F.), then removed from the furnace and allowed to air cool. The broad surfaces were again machined to remove about 0.71 cm (0.28 inch) of thickness per side.

Prior to hot rolling, the ingots were placed in one furnace and reheated to a temperature of 510° C. (950° F.) and allowed to equilibrate at this temperature for about a two hour period. The ingots were then successively hot rolled on a single-stand reversing mill to produce a first intermediate gauge thickness sheet having a thickness of 0.3 cm (0.120 inch) and exited the rolling mill at temperatures from about 338° C. to 349° C. (640° F. to 660° F.). The first intermediate gauge thickness sheet was then wound onto coils. The coils were next annealed in a box-type furnace at about 360° C. (680° F.) for a minimum of four hours and allowed to cool to room temperature.

Following annealing was a cold rolling step which reduced the metal thickness to about 0.0762 cm (0.030 inch). The cold rolled sheet was then wound onto coils. At this point two of the four coils were subjected to a standard batch anneal by placing them in a box-type furnace and heating to about 360° C. (680° F.) for a minimum of four hours, followed by ambient air cooling to room temperature. The other two coils were annealed on a continuous anneal line which was accomplished by unwinding the coil and passing the strip through a heating means, such as heating means 62, which was maintained at a temperature of about 524° C. (975° F.), water spray quenching the strip at the end of the box, and rewinding. All four coils were further cold rolled to about 0.0325 cm (0.0128 inch) thickness.

Testing of resulting strip demonstrated the strength and earing values listed in Table 2. Strength was measured in the post-baked condition to more closely simulate the formed can strength. The post-baked samples were exposed to a 204° C. (400° F.) air furnace for 20 minutes prior to testing. Yield strength was determined using a common tension test wherein the specimen was subjected to a continually increasing force while simultaneous observations were made of the elongation. The yield strength was defined as the load necessary to induce a 0.2% length increase of the specimen divided by the cross-sectional area of the specimen. It is measured in dimensions of Mega Pascals (MPa). The English equivalent is thousands of psi (pounds per square inch) or ksi. Earing values were determined by the common method of drawing a cup 40%. This means that the punch diameter was 40% smaller than the sheet circle diameter. The earing value is expressed as the percent difference between the lowest and highest heights of the drawn cup sidewall.

TABLE 2

| | Post Bake Yield Strength | | | 45° Earing | | |
|---|---|---|---|---|---|---|
| Anneal Type | No. of Tests | Average | Standard Deviation | No. of Tests | Average | Standard Deviation |
| Batch | 8 | 246.33 MPa | 0.90 MPa | 32 | 3.83% | 0.057% |
| Continuous | 8 | 282.21 MPa | 1.73 MPa | 32 | 2.86% | 0.063% |

As can be seen, the continuously annealed sheet exhibited greater average post bake yield strength and lower 45° earing than the batch annealed sheet. These results meet or exceed current product requirements whereas the batch annealed material is both too low in yield strength and too high in earing to be commercially acceptable.

While the invention has been described in terms of referred embodiments, the claims appended hereto are intended to encompass all embodiments which fall within the spirit of the invention.

What is claimed is:

1. A method of producing aluminum can sheet having high strength and low earing characteristics, said method comprising:

providing an aluminum alloy ingot;

hot rolling said ingot, said hot rolling step consisting of hot rolling in a single-stand hot reversing mill to produce a first intermediate gauge sheet, said first intermediate gauge sheet exiting said single-stand hot reversing mill at a temperature between about 249° C. to 405° C. (480° F. to 760° F.);

cold rolling said first intermediate gauge sheet to produce a second intermediate gauge sheet;

passing said second intermediate gauge sheet through heating means to continuously anneal said second intermediate gauge sheet;

cooling said second intermediate gauge sheet; and cold rolling said second intermediate gauge sheet to produce said aluminum can sheet having high strength and low earing characteristics.

2. The method of claim 1, wherein said aluminum alloy ingot consists essentially of about 0.10 to 0.30% Si, about 0.20 to 0.50% Fe, about 0.10 to 0.25% Cu, about 0.8 to 1.5% Mn, and about 0.8 to 1.5% Mg, the balance being aluminum and incidental elements and impurities.

3. The method of claim 1, wherein said aluminum alloy ingot is composed of 3004 aluminum alloy.

4. The method of claim 1, wherein said ingot has a thickness of at least 26.5 cm (10.4 inches).

5. The method of claim 4, wherein said ingot has a thickness of between about 26.5 cm and 60.0 cm (10.4 to 23.6 inches).

6. The method of claim 1, including after hot rolling, winding said first intermediate gauge sheet on a coil.

7. The method of claim 6, including if said first intermediate gauge sheet has a temperature of less than 343° C. (650° F.), heating said coil in a furnace to a temperature of about 329° to 399° C. (625° to 750° F.).

8. The method of claim 7, including removing said coil from said furnace and allowing said coil to air cool to about room temperature.

9. The method of claim 1, including after cold rolling said first intermediate gauge sheet to produce said second intermediate gauge sheet, winding said second intermediate gauge sheet onto a coil;

unwinding said second intermediate gauge sheet from said coil; and passing said second intermediate ague sheet as a single web through a heating means.

10. The method of claim 9, including said heating means having an entrance end and an exit end;

introducing said second intermediate gauge sheet into said entrance end; and passing said second intermediate gauge sheet out of said exit end.

11. The method of claim 10, including maintaining the temperature in said heating means at about 427° to 566° C. (800° to 1050° F.).

12. The method of claim 10, including cooling said second intermediate gauge sheet by quenching.

13. The method of claim 12, including quenching said second intermediate gauge sheet by spraying water on said sheet as it passes out of said exit end.

14. The method of claim 1, wherein said aluminum can sheet has a post bake yield strength of about 40.9 ksi.

15. The method of claim 1, wherein said aluminum can sheet has 45° earing of about 2.86%.

16. A method of producing aluminum can sheet having high strength and low earing characteristics, said method comprising:

providing an aluminum alloy ingot;

hot rolling said ingot, said hot rolling step consisting of hot rolling in a single-stand hot reversing mill to produce a first intermediate gauge sheet, said first intermediate gauge sheet exiting said single-stand hot reversing mill at a temperature between about 249° C. to 405° C. (480° F. to 760° F.);

cold rolling said first intermediate gauge sheet to produce a second intermediate gauge sheet;

continuously annealling said second intermediate gauge sheet at a temperature of at least 427° C. (800° F.);

cooling said second intermediate gauge sheet; and cold rolling said second intermediate gauge sheet to produce said aluminum can sheet having high strength and low earing characteristics.

17. The method of claim 16, wherein said aluminum alloy ingot consists essentially of about 0.10 to 0.30% Si, about 0.20 to 0.50% Fe, about 0.10 to 0.25% Cu, about 0.8 to 1.5% Mn, and about 0.8 to 1.5% Mg, the balance being aluminum and incidental elements and impurities.

18. The method of claim 16, wherein said aluminum alloy ingot is composed of 3004 aluminum alloy.

19. The method of claim 16, wherein said ingot has a thickness of at least 26.5 cm (10.4 inches).

20. The method of claim 19, wherein said ingot has a thickness of between about 26.5 cm and 60.0 cm (10.4 to 23.6 inches).

21. The method of claim 16, wherein cooling said second intermediate gauge sheet by quenching.

22. The method of claim 21, including quenching said second intermediate gauge sheet by spraying water on said sheet as it passes out of said exit end.

23. The method of claim 16, including continuously annealling said second intermediate gauge sheet at said continuous annealling temperature for at least 2 seconds.

24. The method of claim 23, including cooling said second intermediate gauge sheet from said continuously annealling temperature to a temperature of about 10° to 121° C. (50° to 250° F.).

25. The method of claim 24, including cooling said second intermediate gauge sheet at a rate of at least about 10° C./sec (18° F./sec).

26. A method of producing aluminum can sheet having high strength and low earing characteristics, said method comprising:

providing an aluminum alloy ingot;

heating said ingot to a preheat temperature;

allowing said ingot to cool from said preheat temperature to room temperature;

heating said ingot to a hot rolling temperature;

hot rolling said ingot, said hot rolling step consisting of hot rolling in a single-stand hot reversing mill to produce a first intermediate gauge sheet, said first intermediate gauge sheet exiting said single-stand hot reversing mill at a temperature between about 249° C. to 405° C. (480° F. to 760° F.);

coiling said first intermediate gauge sheet on a first coil;

cold rolling said first intermediate gauge sheet to produce a second intermediate gauge sheet;

coiling said second intermediate gauge sheet on a second coil;

uncoiling said second intermediate gauge sheet from said second coil;

annealling said uncoiled second intermediate gauge sheet;

cooling said uncoiled second intermediate gauge sheet;

coiling said cooled second intermediate gauge sheet; and cold rolling said second intermediate gauge sheet to produce said aluminum can sheet having high strength and low earing characteristics.

* * * * *